US007681758B2

(12) United States Patent
Murayama et al.

(10) Patent No.: US 7,681,758 B2
(45) Date of Patent: Mar. 23, 2010

(54) GAS CARTRIDGE

(75) Inventors: Keijiro Murayama, Tokyo (JP); Katsuhiko Murayama, Tokyo (JP); Jyunichi Tamura, Tokyo (JP); Masakazu Konishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 396 days.

(21) Appl. No.: 11/657,717

(22) Filed: Jan. 25, 2007

(65) Prior Publication Data

US 2007/0181596 A1 Aug. 9, 2007

(30) Foreign Application Priority Data

Jan. 27, 2006 (JP) ..... P.2006-019119
Mar. 30, 2006 (JP) ..... P.2006-095386
May 12, 2006 (JP) ..... P.2006-133662
Nov. 8, 2006 (JP) ..... P.2006-303324

(51) Int. Cl.
*B65D 35/28* (2006.01)

(52) U.S. Cl. ..... 222/3; 222/95; 222/105; 222/183; 222/386.5

(58) Field of Classification Search ..... 222/95, 222/105, 386.5, 183, 3
See application file for complete search history.

(56) References Cited

U.S. PATENT DOCUMENTS

| | | | | |
|---|---|---|---|---|
| 3,389,833 | A | 6/1968 | Ramis | |
| 3,721,371 | A | 3/1973 | Dolveck | 222/386.5 |
| 3,905,517 | A | 9/1975 | Friedrich et al. | 222/95 |
| 3,979,025 | A | 9/1976 | Friedrich | 222/95 |
| 4,013,195 | A | 3/1977 | Ferris | 222/95 |
| 4,095,724 | A | 6/1978 | Perusco | 222/95 |
| 4,403,722 | A | 9/1983 | Nikolich | 227/8 |
| 4,415,099 | A | 11/1983 | Paris | 222/94 |
| 4,483,474 | A | 11/1984 | Nikolich | 227/8 |
| 4,969,577 | A * | 11/1990 | Werding | 222/94 |
| 5,069,590 | A | 12/1991 | Stoffel | 413/1 |
| 5,115,944 | A | 5/1992 | Nikolich | 222/94 |
| 5,337,923 | A * | 8/1994 | Lugez et al. | 222/183 |
| 6,328,409 | B1 | 12/2001 | Peeters et al. | 347/21 |
| 6,340,216 | B1 | 1/2002 | Peeters et al. | 347/21 |
| 6,416,156 | B1 | 7/2002 | Noolandi et al. | 347/21 |
| 6,416,157 | B1 | 7/2002 | Peeters et al. | 347/21 |
| 6,416,158 | B1 | 7/2002 | Floyd et al. | 347/21 |
| 6,416,159 | B1 | 7/2002 | Floyd et al. | 347/21 |
| 6,454,384 | B1 | 9/2002 | Peeters et al. | 347/21 |
| 6,467,862 | B1 | 10/2002 | Peeters et al. | 347/7 |
| 2004/0000562 | A1 | 1/2004 | Gantner | 222/95 |

FOREIGN PATENT DOCUMENTS

DE 19 00 704 A1 8/1970

(Continued)

*Primary Examiner*—Kevin P Shaver
*Assistant Examiner*—Andrew P Bainbridge
(74) *Attorney, Agent, or Firm*—Morgan, Lewis & Bockius LLP

(57) ABSTRACT

In a gas cartridge, inside of an outer can 1 is arranged with an inner bag 2 charged with a gas, and a space between the outer can 1 and the inner bag 2 is charged with a compression gas G2 for pressing to crush the inner bag 2 in accordance with consumption of the gas. The outer can 1 is integrally formed with a deformation introducing portion P1 for producing an initial deformation at the inner bag 2.

3 Claims, 9 Drawing Sheets

FOREIGN PATENT DOCUMENTS

| | | | |
|---|---|---|---|
| DE | 1 917 247 | | 10/1970 |
| DE | 202 00 906 U 1 | | 7/2002 |
| FR | 1 303 048 | | 9/1962 |
| FR | 1 428 355 | A | 5/1966 |
| FR | 2 259 754 | | 8/1975 |
| FR | 2 316 132 | | 1/1977 |
| FR | 2 280 127 | A1 | 8/2002 |
| GB | 1 072 404 | A | 6/1967 |
| JP | 49 003213 | | 1/1974 |
| JP | 55-48068 | | 4/1980 |
| JP | 55-26073 | | 7/1980 |
| JP | 57-178676 | | 11/1982 |
| JP | 59-131267 | | 9/1984 |
| JP | 60-18927 | | 2/1985 |
| JP | 60-148281 | | 10/1985 |
| JP | 60-169163 | | 11/1985 |
| JP | 61-246051 | | 11/1986 |
| JP | 05-077844 | | 3/1993 |
| JP | B2-2873691 | | 1/1999 |
| JP | 06-005618 | | 1/2004 |
| JP | 2004-044804 | | 2/2004 |
| JP | 2005 263285 | | 9/2005 |
| TW | 183169 | | 5/1992 |
| TW | 359476 | | 5/1999 |
| TW | 415280 | | 12/2000 |
| TW | 458895 | | 10/2001 |
| TW | 491728 | | 6/2002 |
| TW | 543513 | | 7/2003 |
| TW | 1232916 | | 5/2005 |

* cited by examiner

GAS CARTRIDGE

BACKGROUND OF THE INVENTION

1. Technical Field

The present invention relates to a gas cartridge for supplying a fuel gas used in a strike tool of a gas nailer or the like for striking a fastener of a nail, a screw or the like by a combustion pressure of the gas, or a gas cartridge for charging a cosmetic agent, an insect preventing agent, an insecticide or the like.

2. Background Art

A strike tool for striking a fastener of a nail, a screw or the like by a combustion pressure of a gas is charged with a gas cartridge and the gas is supplied from the gas cartridge. In a normal case, a gas cartridge is provided with a multiple structure comprising an outer vessel (outer can), a gas charge vessel (inner bag), and an inner space formed between the two vessels. A liquefied fuel gas at inside of the gas charge vessel is injected by compressing to deform the gas charge vessel by utilizing a pressure of a compression gas at high pressure charged into the inner space.

Further, the outer vessel and the gas charge vessel of the gas cartridge having the above-described two chamber structure pressure charging apparatus are made of aluminum, particularly, the gas charge vessel is easy to be deformed by receiving a press force of the compression gas, the gas at inside is not permeated to outside, and therefore, a comparatively thin vessel which is easily deformable is preferred (JP-B2-2873691).

Meanwhile, according to the vessels of the multiple structure of the gas cartridge, the fuel gas at inside of the gas charge vessel is discharged to outside of the gas cartridge by pressing to crush to thereby recess to deform the gas charge vessel by the pressure of the compression gas charged to the inner space between the two vessels. Deformation of the gas charge vessel utilizing the pressure of the gas is free deformation, and therefore, there is a case in which the gas charge vessel is not uniformly deformed. That is, at an initial stage of deforming the gas charge vessel, a portion having a weak rigidity is recessed to deform, deformation of the portion is further promoted, and therefore, in a number of cases, only one portion is considerably recessed to deform.

Further, since an opening portion and a bottom portion of the gas charge vessel are highly rigid and difficult to be deformed, and therefore, a stress is concentrated on a portion excluding these portions, further, deformation is continuously progressed from an initially deformed portion which is deformed initially, and therefore, only one portion is considerably deformed. Therefore, there is a case in which a wrinkle or a fold is brought about at the portion, and a crack or a pin hole is produced. For example, as shown by FIG. 11, a bottom portion 12 of an inner bag 2 is pulled to an opening side, a stress is liable to be concentrated on a boundary portion 13 between the bottom portion 12 and a side face portion 10, and therefore, there is brought about a phenomenon that the bottom portion 12 is considerably deformed to fall down to the opening side. When a crack or a pin hole is produced at the gas charge vessel in accordance therewith, the compression gas is brought into the inner bag charged with a gas, and therefore, the pressure of the compression gas is relatively reduced and a gas charge vessel is not sufficiently compressed. Therefore, the fuel gas is discharged insufficiently, and a function thereof as a gas can is lost while the fuel gas remains. Abandoning the fuel gas before being sufficiently utilized not only deteriorates an operational efficiency of the strike tool constituting a drive source by the gas but also constitutes an economic loss.

In this way, according to the gas cartridge, both of the outer can and the inner bag are made of a metal, particularly, the inner bag is thin-walled, and therefore, there poses a particular problem that a crack or a pin hole is liable to be produced.

SUMMARY OF THE INVENTION

One or more embodiments of the invention provide a gas cartridge in which a deformation of recessing an inner bag is made not to be deviated by preventing a stress from being concentrated only on a portion of the inner bag by a compression gas to thereby enable to effectively prevent a crack or a pin hole from being produced at the inner bag by improving the gas cartridge by particularly placing a view point to improving the inner bag.

According to a first aspect of the invention, there is provided a gas cartridge, wherein inside of an outer can is arranged with an inner bag charged with a gas and a compression gas for pressing to crush the inner bag in accordance with consumption of the gas is charged to a space between the outer can and the inner bag, the gas cartridge comprising a deformation introducing portion integrally formed with the outer can for producing an initial deformation at the inner bag.

According to a second aspect of the invention, in the gas cartridge according to the first aspect, the deformation introducing portion may include a projected streak portion projected to an inner side of the outer can, and an inner diameter of the outer can including the projected streak portion may be substantially equal to an outer diameter of the inner bag.

Further, according to a third aspect of the invention, in the gas cartridge according to the first aspect, the deformation introducing portion may include a projected streak portion projected to an inner side of the outer can, and an inner diameter of the outer can including the projected streak portion may be smaller than an outer diameter of the inner bag.

According to the first aspect of the gas cartridge, when the initial deformation is produced at the inner bag by the deformation introducing portion formed at the outer can, in charging to use the gas cartridge to a strike tool of a gas nailer or the like, the inner bag is pressed to crush to deform by the compression gas in accordance with the consumption of the gas at inside of the inner bag. At this occasion, initially deformed initial deformation promotes successive deformation, and therefore, the deformation is progressed successively from the initially deformed portion. In this way, the deformation can be introduced intentionally, and the deformation by the compression gas can be dispersed to a plurality of portions such that the deformation is not deviated to a portion on which a stress is concentrated. Further, the initial deformation is determined by the deformation introducing portion, and therefore, there is a low possibility of initially deforming a portion which is physically inferior in a rigidity thereof the most. Therefore, a crack or a pin hole by a wrinkle or a fold can effectively be prevented from being brought about.

Further, according to the second aspect of the gas cartridge, the inner bag is bulged by the gas pressure when the gas is charged, and therefore, a portion thereof is butted to the projected portion projected to the inner side of the outer can. The butted portion is recessed, and therefore, initial deformation can be produced.

Further, according to the third aspect of the gas cartridge, the inner diameter of the outer can including the projected portion projected to the inner side of the outer can as the deformation introducing portion according to the first aspect is made to be smaller than the outer diameter of the inner bag, and therefore, when the inner bag is forcibly pressed to inside of the outer can, the deformation introducing portion is pressed to the outer face of the inner bag. Therefore, the outer face of the inner bag is deformed in accordance with the shape of the projected portion, and the initial deformation can be produced regardless of charging the gas.

Other aspects and advantages of the invention will be apparent from the following description and the appended claims.

BRIEF DESCRIPTION OF THE DRAWINGS

FIG. 7 is a vertical sectional view showing sizes of an inner bag and a deformation introducing portion before being pressed in.

FIG. 8 is a vertical sectional view showing a state of the inner bag and the deformation introducing portion and an outer can after having been pressed in.

DESCRIPTION OF REFERENCE NUMERALS AND SIGNS

A cartridge
1 outer can
2 inner bag
P1 projected streak portion (deformation introducing portion)

DETAILED DESCRIPTION OF THE EXEMPLARY EMBODIMENTS

An explanation will be given of an exemplary embodiment and a number of modes of the invention in reference to the drawings as follows.

Although a gas charged to an inner bag is normally a liquefied gas, the gas is not necessarily limited to be the liquefied gas.

Figure 1:
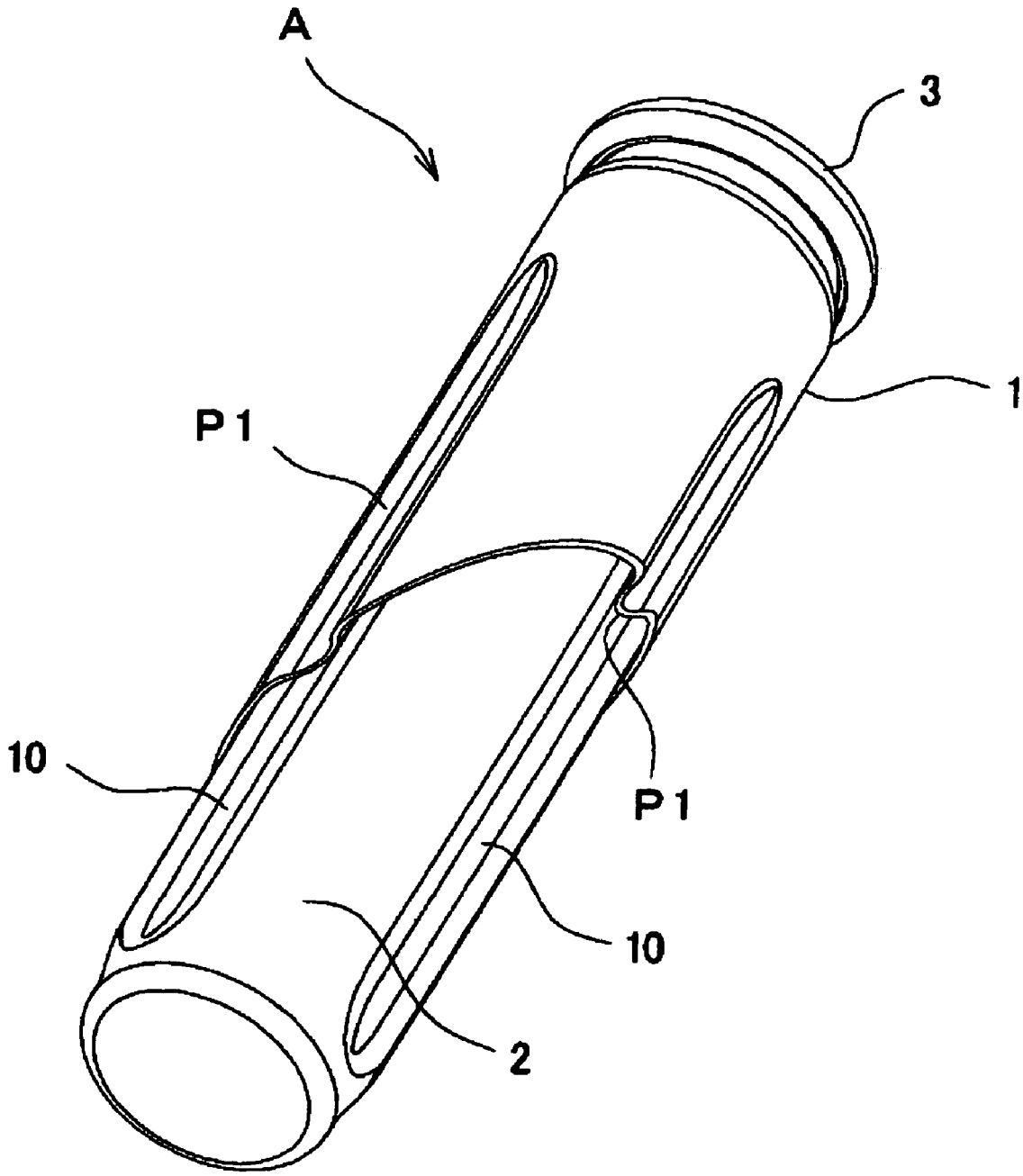
FIG. 1 is a perspective view of a gas cartridge according to an exemplary embodiment of the invention.
Figure 2A:
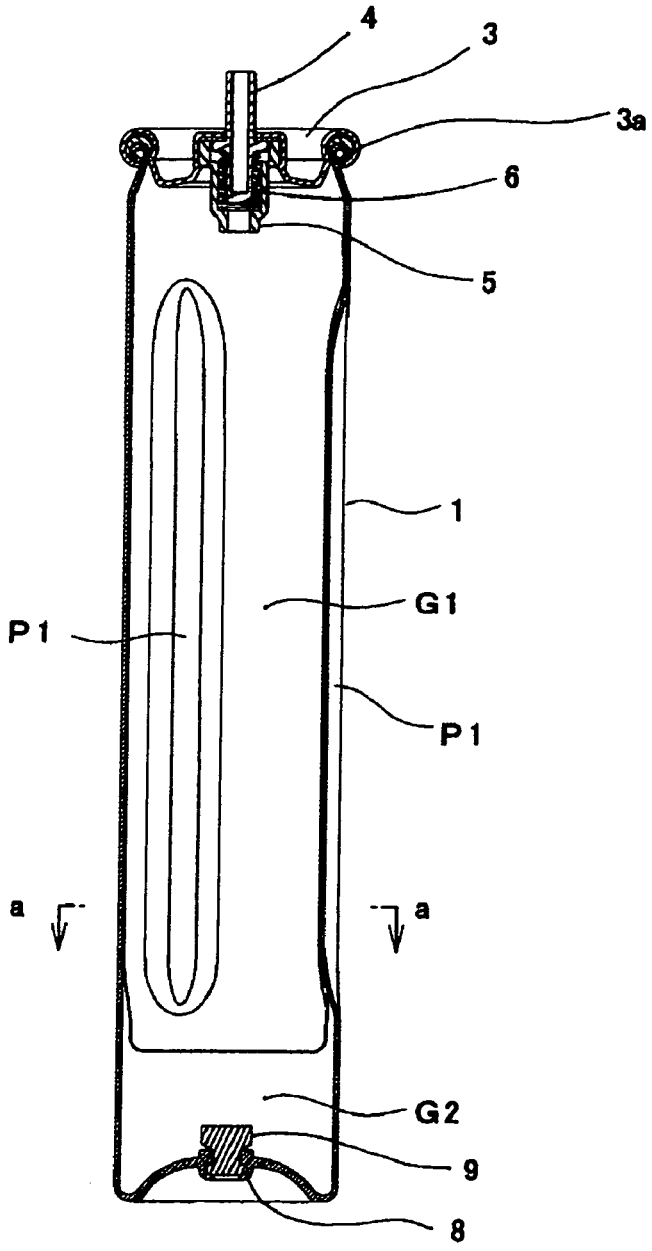
FIG. 2A is a vertical sectional view of the gas cartridge.
Figure 2B:
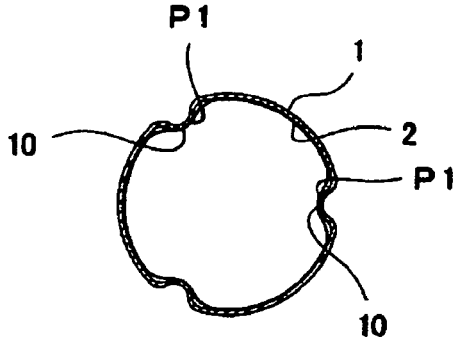
FIG. 2B is a sectional view taken along a line a-a of FIG. 2A.
Figure 3:
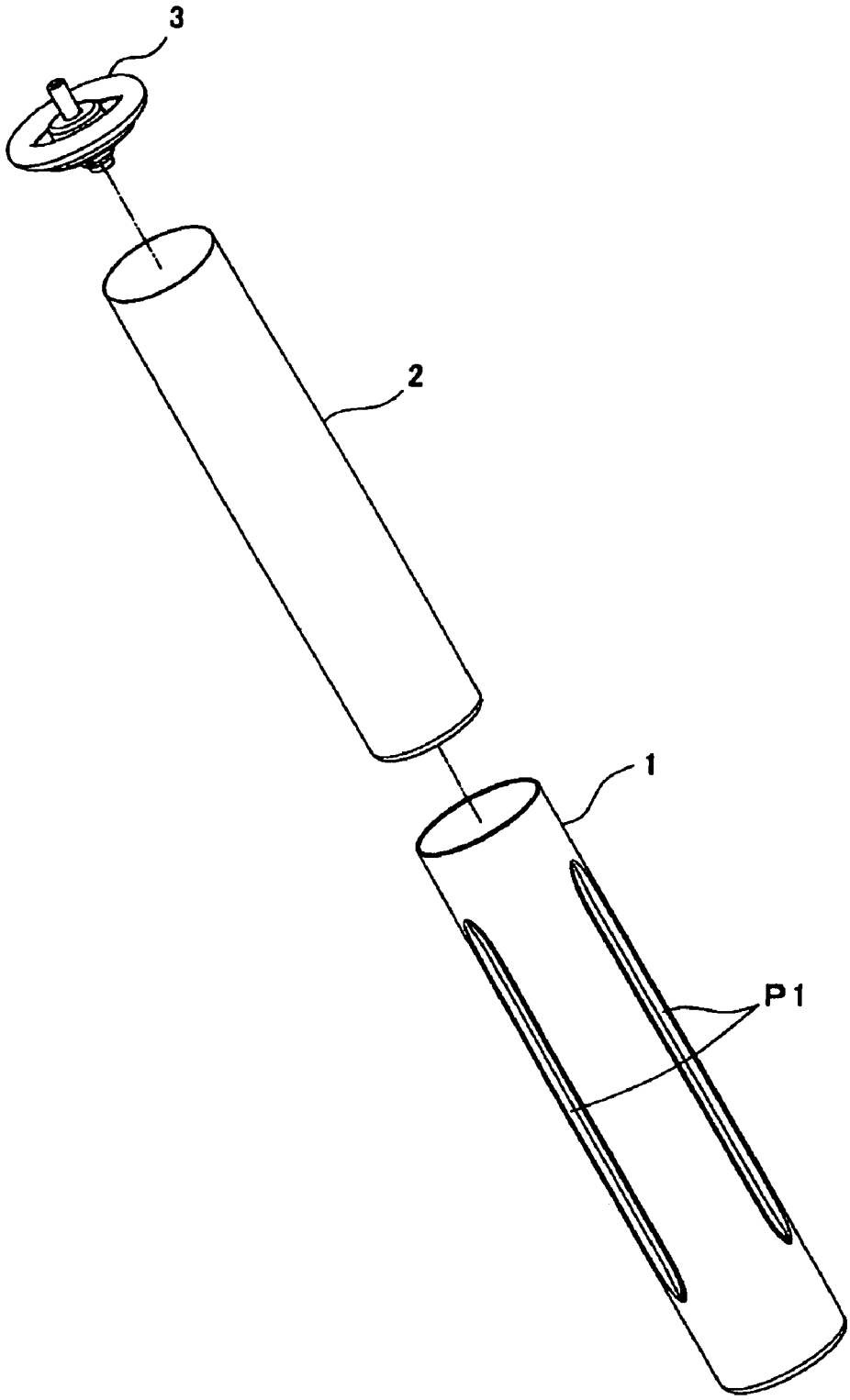
FIG. 3 is a disassembled perspective view of the gas cartridge.

In FIG. 1 through FIG. 3, notation A designates a gas cartridge. The gas cartridge A is constituted by an outer can 1, an inner bag 2 arranged at inside of the outer can 1, a cap valve member 3 for injecting a gas charged into the inner bag 2 and the like.

As shown by FIG. 3, the outer can 1 comprises a cylindrical member made of aluminum having a predetermined diameter and a predetermined length and a predetermined wall thickness, one end thereof is opened and other end thereof is closed. In contrast thereto, the inner bag 2 is arranged at inside of the outer can 1, and therefore, in a state in which a gas to be charged to inside thereof is not charged yet, the inner bag 2 comprises a thin aluminum made bottomed cylindrical member which is provided with an outer shape similar to that of the outer can 1, smaller than the outer can 1, and easy to be deformed.

Figure 4A:
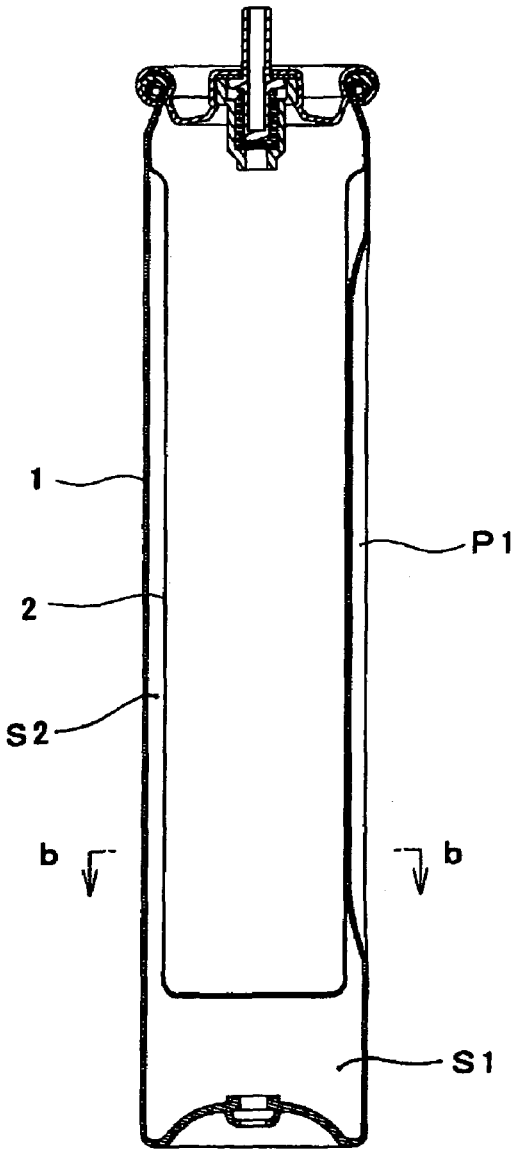
FIG. 4A is a vertical sectional view of the gas cartridge before charging a gas.
Figure 4B:
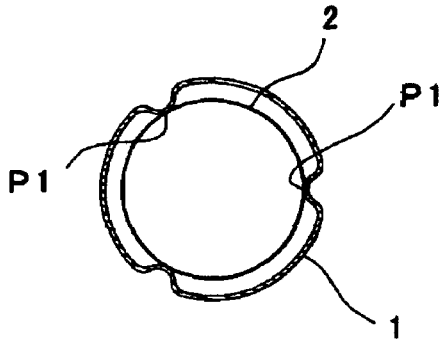
FIG. 4B is a sectional view taken along a line b-b of FIG. 4A.

The inner bag 2 is inserted into the outer can 1. Further, opening edges of the outer can 1 and the inner bag 2 are integrally bonded to each other by being seamed to a peripheral edge 3*a* of the cap valve member 3. Further, in a state in which the gas is not charged yet, as shown by FIG. 4A and FIG. 4B, a side portion space S2 is formed between an outer peripheral face of the inner bag 2 and an inner peripheral face of the outer can 1. At the same time, a bottom portion space S1 is continuously formed between a bottom portion of the outer can 1 and a bottom portion of the inner bag 2.

Inside of the inner bag 2 is charged with a liquefied fuel gas G1 from an injection pipe 4 of the cap valve member 3. At this occasion, the inner bag 2 is bulged as shown by FIG. 2. Further, the inner spaces S1, S2 of the outer can 1 of the vessel are charged with a compression gas G2 for pressing to crush the inner bag 2 for injecting the gas. The compression gas G2 is at a pressure higher than a pressure of the liquefied fuel gas G1 for injecting the liquefied fuel gas G1 from the injection pipe 4 of the cap valve member 3 to outside by pressing a surface of the inner bag 2 and pressing to crush the inner bag 2 and normally, a gas of propane, propylene, butane or the like is used therefor. The bottom portion of the outer can 1 is formed with a cap 8 for charging the compression gas, the compression gas G2 is charged therefrom, and the cap 8 is sealed by a plug 9.

Thereby, as shown by FIG. 1, FIG. 2A and FIG. 2B, there is formed the gas cartridge A having a double structure of a concentrical arrangement mainly constituted by the outer can 1 and the inner bag 2 and including the cap valve member 3.

In the above-described constitution, when the gas cartridge is used for a strike tool or the like, by pressing the injection pipe 4 against a force of a spring 6 for urging a valve member 5, the valve member 5 is opened, thereby, the gas at inside of the inner bag 2 is injected to outside. Further, in accordance with discharging the gas at inside of the inner bag 2, the inner bag 2 is going to be pressed to crush by the compression gas G2 at high pressure at inside of the outer can 1, since the pressure at inside of the inner bag 2 is not reduced, the liquefied fuel gas G1 is continuously injected.

Next, the gas cartridge A is formed with 3 pieces of projected streak portions P1 (not limited to 3 pieces) projected to an inner side of the outer can 1 uniformly along a longitudinal direction as a deformation introducing portion.

That is, as shown by FIG. 3, the respective projected streak portions P1 are formed by pressing to work a surface of the outer can 1, all thereof are constituted by the same length, and slenderly formed along a length direction of the outer can 1. Further, the respective projected streak portions P1 are formed to correspond to a center portion of the inner bag 2 upward from a bottom portion thereof and downward from an opening portion thereof.

An inner diameter of the outer can 1 including the projected streak portion P1 is formed to be substantially the same as an outer diameter of the inner bag 2.

Therefore, although when the gas is not charged yet, there is brought about a state of FIG. 4A and FIG. 4B, when the fuel gas G1 is charged to the inner bag 2 as described above, the inner bag is bulged by a pressure thereof, and therefore, a portion thereof is butted to the projected streak portion P1 formed at the outer can 1. The butted portion is recessed, and therefore, as shown by FIG. 1, FIG. 2A and FIG. 2B, an outer peripheral face of the inner bag 2 is formed with a recessed portion 10 in a shape of a uniform recessed streak as an initial deformation.

According to the embodiment, when the gas cartridge A is used by being charged to a strike tool of a gas nailer or the like, the inner bag 2 is pressed to crush and deform by the compression gas G2 in accordance with consumption of the gas at inside of the inner bag 2, the recessed portion 10 promotes a successive deformation, and therefore, the deformation is progressed successively from the recessed portion 10. In this way, the deformation can intentionally be introduced. Further, the deformation by pressing is uniformly dispersed to 3 portions. Further, the initial deformation is started from the recessed portion 10, and therefore, there is a low possibility of initially deforming a portion which is physically inferior in a rigidity thereof the most. Therefore, a crack or a pin hole by a wrinkle or a fold can effectively be prevented from being brought about.

Although according to the embodiment, an explanation has been given of the deformation introducing portion by the projected streak portion P1 prolonged in the longitudinal direction relative to the outer can 1, there may be constructed a constitution of constituting a projected portion intermittently formed in the longitudinal direction and projected to the inner side to thereby deform the outer peripheral face of the inner bag 2 uniformly.

Means for forming the recessed portion 10 at the other peripheral face of the inner bag 2 is not limited to the above-described. Next, a number of examples thereof will be explained. For example, In FIG. 5 and FIG. 6, the outer peripheral face of the outer can 1 is formed with 3 pieces of the projected streak portions P1 at equal intervals as deformation introducing portions in a peripheral direction thereof similar to the mode of FIG. 1. The respective projected streak portions P1 are constituted by the same length and slenderly formed along the length direction of the outer can 1. Further, the respective projected streak portions P1 are formed to correspond to the center portion of the inner bag 2 upward from the bottom portion and downward from the opening portion. Thereby, the projected streak portions P1 are formed as 3 pieces of the projected streak portions P1 at the inner face of the outer can 1. Further, as shown by FIG. 7, an inner diameter d1 of the outer can 1 including the projected streak portions P1 is formed to be smaller than an outer diameter d2 of the inner bag 2.

Figure 8:
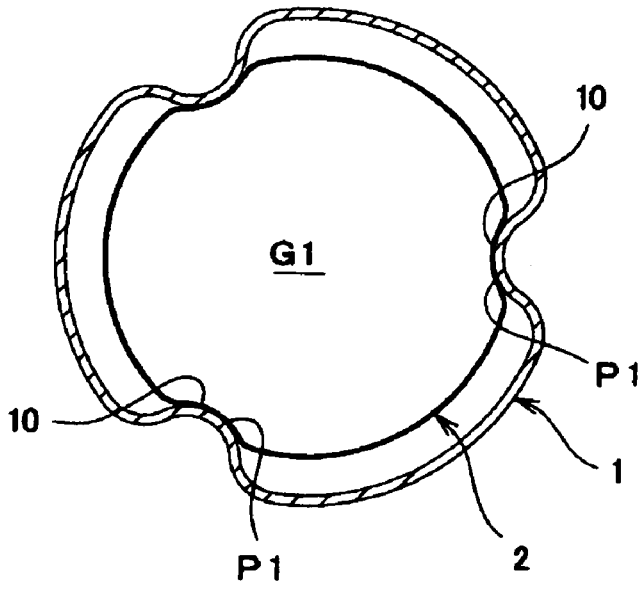

In integrating the gas cartridge, when the inner bag 2 is integrated to inside of the outer can 1, the inner bag 2 is forcibly pressed to inside of the outer can 1. Thereby, as shown by FIG. 6 and FIG. 8, the projected streak portion P1 is pressed to the outer face of the inner bag 2, and therefore, as shown by FIG. 8, the outer face of the inner bag 2 is produced with the recessed portion 10 in accordance with the shape of the projected streak portion P1. Further, a degree of deforming the recessed portion 10 is further increased by charging the fuel gas G1 into the inner bag 2. Therefore, the outer surface of the inner bag 2 can firmly be formed with the recessed portion 10 as the initial deformation.

Therefore, when the inner bag 2 is pressed to crush and deform by the compression gas in accordance with consumption of the gas at inside of the inner bag 2 in being used, the recessed portion 10 promotes deformation of the inner bag 2, the deformation is introduced to progress further from the respective recessed portions 10, and therefore, the deformation by the compression gas is effectively dispersed, and a crack or a pin hole can effectively be prevented from being brought about.

Figure 9:
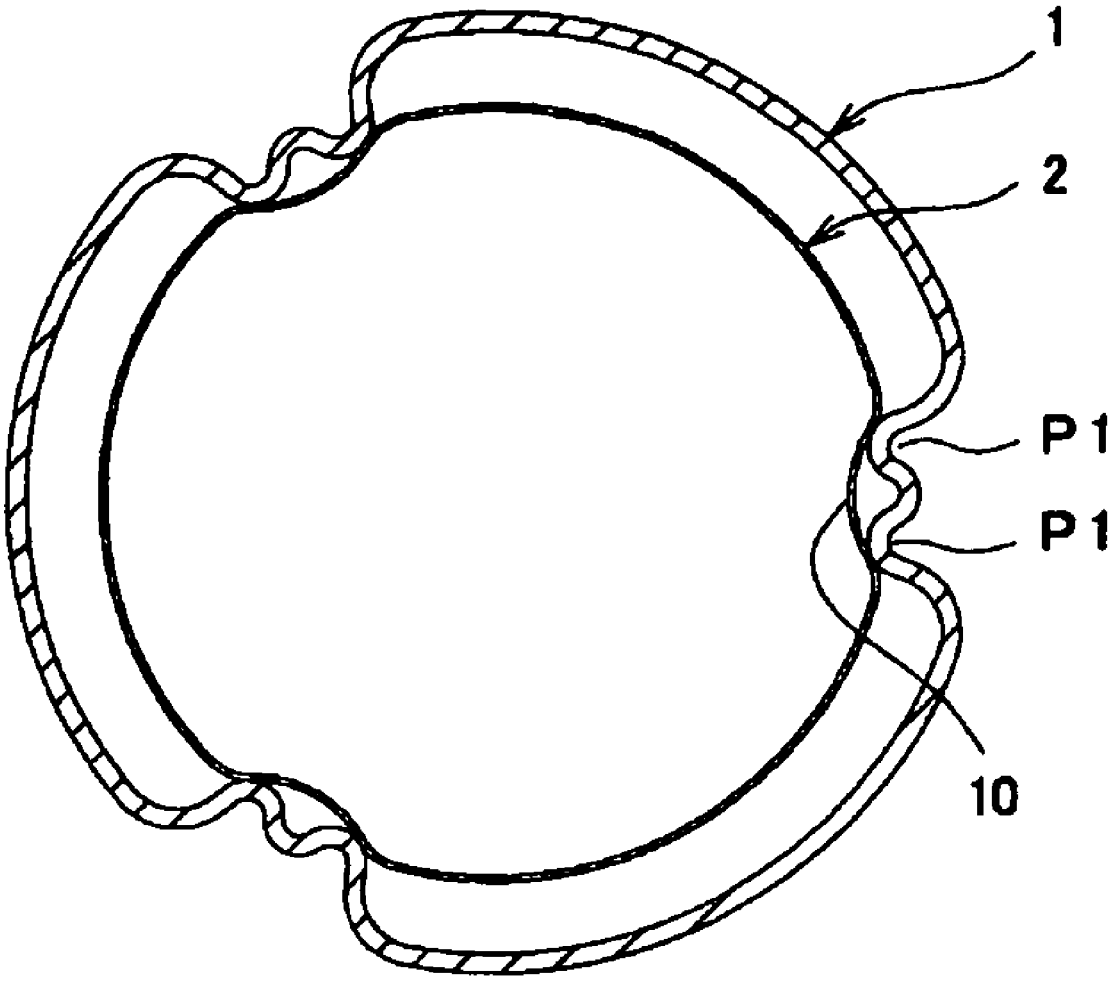
FIG. 9 is a sectional view of other mode of a deformation introducing portion.

Further, a sectional shape of the projected streak portion P1 is not limited to one streak. There may be constituted a shape in which two streaks of the projected streak portions P1 are doubly formed in a transverse direction as shown by FIG. 9.

Further, the deformation introducing portion formed at the outer can may be constituted not by the projected streak portion but by a projected portion in a shape of a circular cone and by pressing the inner bag into the outer can while rotating the inner bag. In this case, the inner bag is formed with an initial deformation in a spiral shape.

Figure 5:
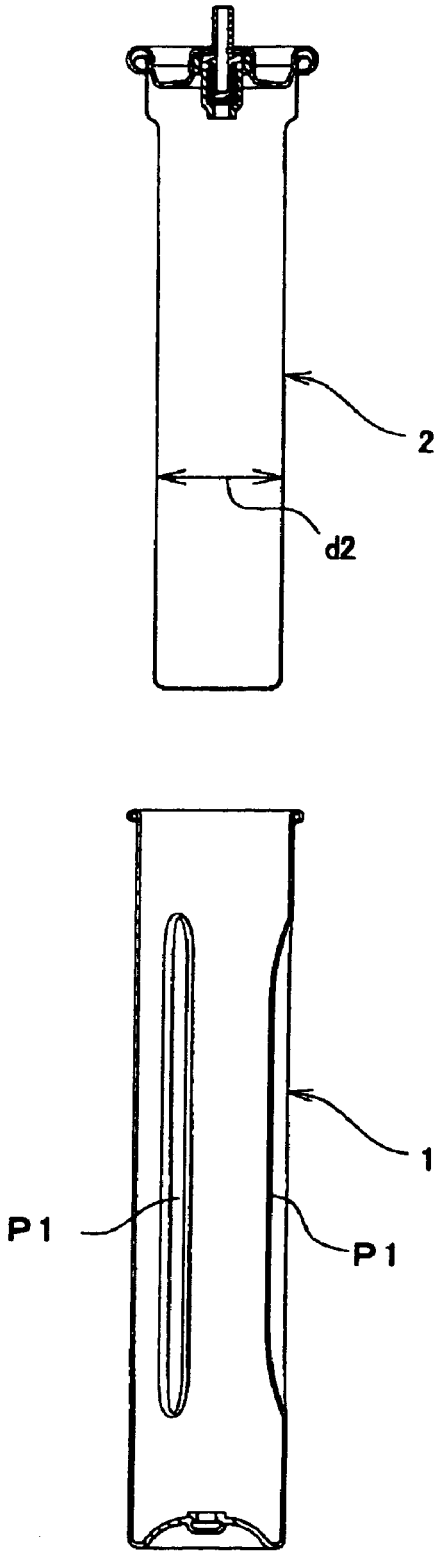
FIG. 5 is a disassembled view of other mode of a gas cartridge.
Figure 6:
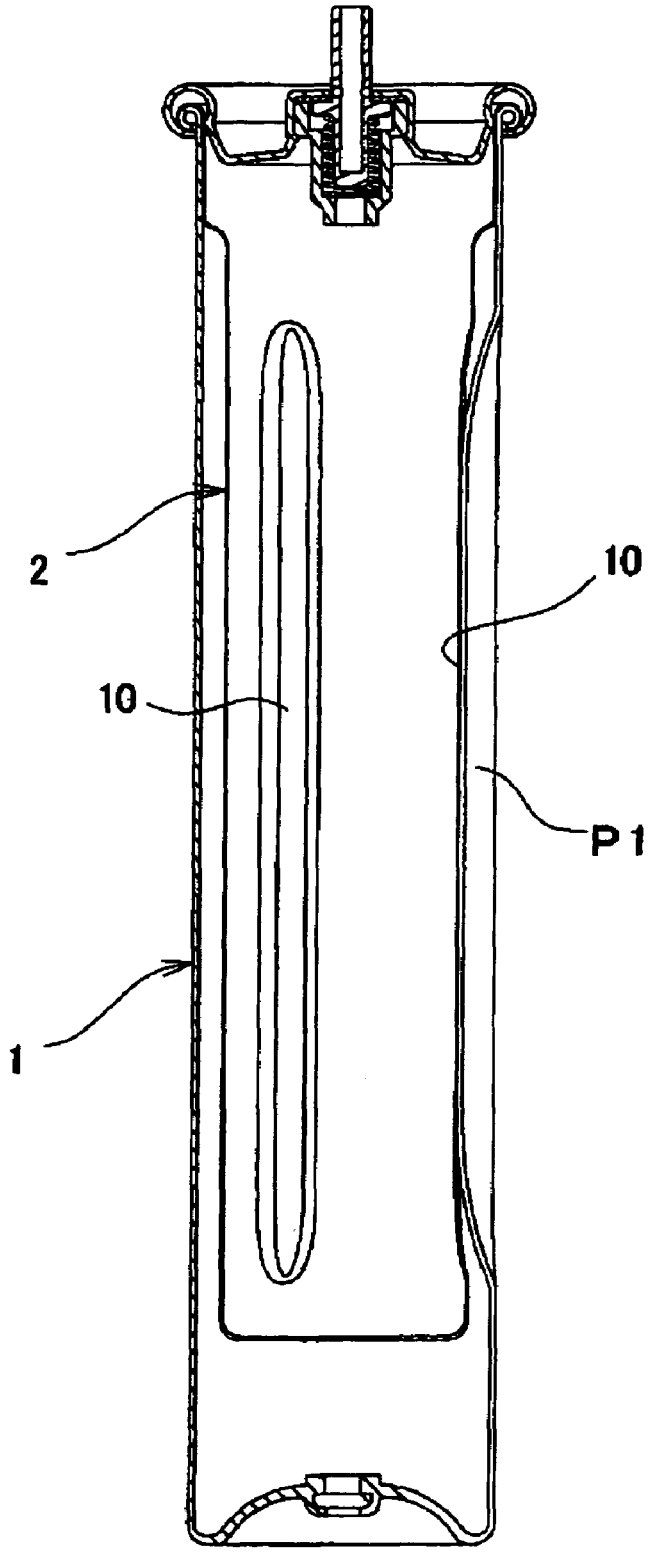
FIG. 6 is a vertical sectional view of a gas cartridge.
Figure 7:
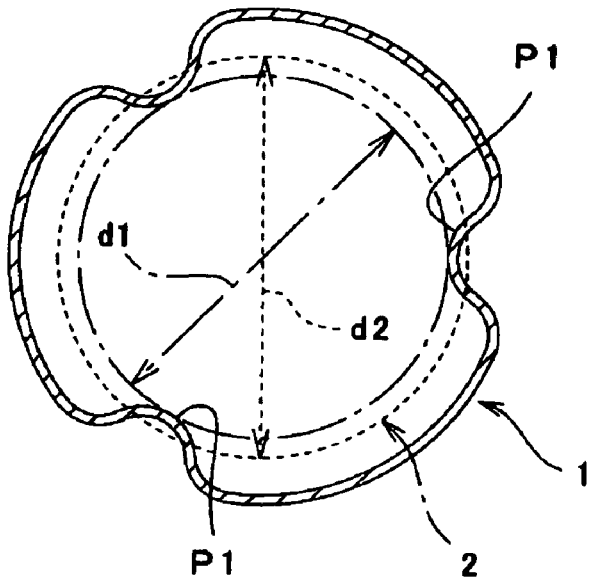

Furthermore, a type of forming the recessed portion 10 at the inner bag 2 is not limited to the mode of forcibly pressing the inner bag 2 to inside of the outer can 1 as shown by FIG. 6. For example, although not illustrated, the outer can 1 is not formed with the projected streak portion P1 as shown by FIG. 5, and the inner bag 2 in a dimensional relationship similar to that shown in FIG. 7 is inserted into the outer can 1. At this occasion, although the outer can 1 is not actually formed with the projected streak portion, a dimension of the inner diameter of the outer can 1 is set as if the projected streak portion P1 were formed. After insertion, the surface of the outer can 1 is applied with a predetermined impact from outside by pertinent means. Also thereby, the surface of the outer can 2 can be formed with the projected streak portion, at the same time, also the outer face of the inner bag 2 can be formed with the recessed portion of the initial deformation in accordance with the shape of the projected streak portion similar to the case shown in FIG. 8.

Figure 10A:
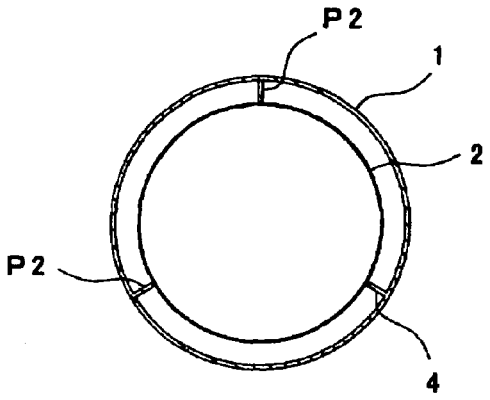
FIG. 10A is a cross-sectional view showing a mode of forming a deformation introducing portion in a rib-like shape and showing a state before charging a fuel gas.
Figure 10B:
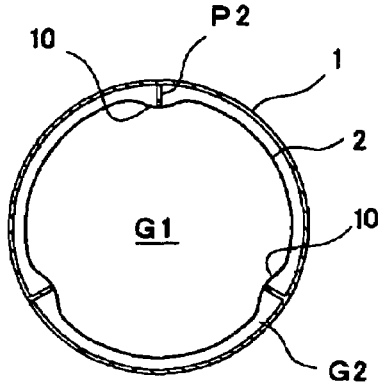
FIG. 10B is a cross-sectional view showing deformation after charging the fuel in the mode of FIG. 10A.
Figure 11:
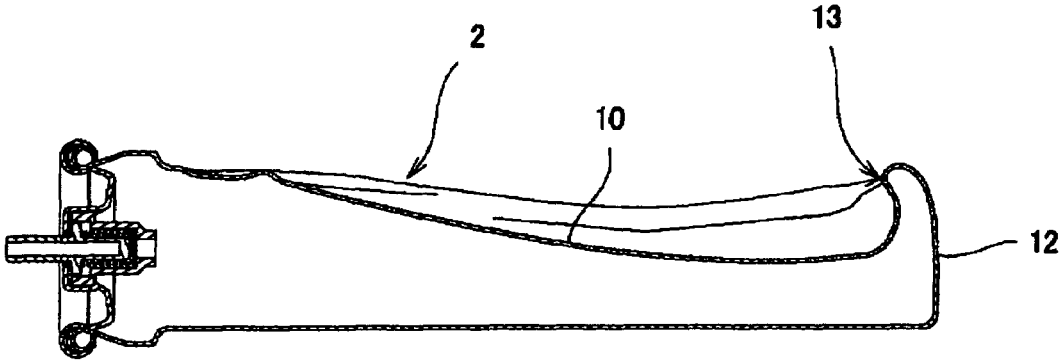
FIG. 11 is a cross-sectional view showing an inner bag in using a gas cartridge of a background art.

Meanwhile, the projected streak portion P1 as the deformation introducing portion may be formed in a rib-like shape as shown by FIG. 10A and FIG. 10B. That is, 3 pieces of rib-like projected streak portions P2 are formed along the longitudinal direction at equal intervals in the peripheral direction of the outer peripheral face of the outer can 1. Although when the gas is not charged yet, the state of FIG. 10A is brought about, when the fuel gas G1 is charged to the inner bag 2, the inner bag 2 is bulged, as shown by FIG. 10B, the outer peripheral face of the inner bag 2 is formed with the recessed portion 10 constituting the initial deformation by the rib-like projected streak portion P2.

Also in this case, the inner bag 2 is pressed to crush and deform by the compressing as G2 at high pressure in accordance with consumption of the gas at inside of the inner bag 2, the deformation is urged precedingly from the deformation recessed portion 10 to progress, and therefore, deformation by pressing is dispersed uniformly to 3 portions, and a crack or a pin hole can effectively be prevented from being brought about.

Although an explanation has been given of the invention in details and in reference to the specific embodiments, it is apparent for the skilled person that the invention can variously be changed or modified without deviating from the spirit and the range of the invention.

The application is based on Japanese Patent Application (Japanese Patent Application No. 2006-019119) filed on Jan. 27, 2006, Japanese Patent Application (Japanese Patent Application No. 2006-095386) filed on Mar. 30, 2006, Japanese Patent Application (Japanese Patent Application No. 2006-133662) filed on May 12, 2006, and Japanese Patent Application (Japanese Patent Application No. 2006-303324) filed on Nov. 8, 2006, and a content thereof is incorporated herein by reference.

INDUSTRIAL APPLICABILITY

The invention is applicable to a gas cartridge for supplying a fuel gas used in a strike tool of a gas nailer or the like for striking a fastener of a nail, a screw or the like by a combustion pressure of the gas, or a gas cartridge for charging a cosmetic agent, an insect preventing agent, an insecticide or the like.

What is claimed is:

1. A gas cartridge comprising:

an outer can;

an inner bag made of a metal and arranged inside the outer can, wherein the inside of the inner bag is charged with gas, and compressed gas for pressing the inner bag in accordance with consumption of the gas is charged to a space between the outer can and the inner bag; and a deformation introducing portion integrally formed on the outer can for producing an initial deformation at the inner bag, wherein the deformation introducing portion slenderly extends along the longitudinal direction of the outer can, and the deformation introducing portion is configured by denting a part of the outer can from a radially outer side of the outer can to protrude the part in a radially inner direction of the outer can.

2. The gas cartridge according to claim 1, wherein the deformation introducing portion comprises a projected streak portion projected to an inner side of the outer can, and an inner diameter of the outer can formed with the projected streak portion is substantially equal to an outer diameter of the inner bag.

3. The gas cartridge according to claim 1, wherein the deformation introducing portion comprises a projected streak portion projected to an inner side of the outer can, and an inner diameter of the outer can formed with the projected streak portion is smaller than an outer diameter of the inner bag.

* * * * *